US007523808B2

(12) United States Patent
Futamura

(10) Patent No.: US 7,523,808 B2
(45) Date of Patent: Apr. 28, 2009

(54) MAST ASSEMBLY IN FORKLIFT TRUCK

(75) Inventor: Tomonori Futamura, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 10 days.

(21) Appl. No.: 11/726,136

(22) Filed: Mar. 20, 2007

(65) Prior Publication Data

US 2007/0221450 A1 Sep. 27, 2007

(30) Foreign Application Priority Data

Mar. 22, 2006 (JP) ..... 2006-078581

(51) Int. Cl.
*B66F 9/12* (2006.01)
*B66F 9/06* (2006.01)
*B66F 9/08* (2006.01)

(52) U.S. Cl. ..... 187/237; 187/226; 187/238

(58) Field of Classification Search ..... 187/222, 187/226, 229, 230, 233, 234, 238
See application file for complete search history.

(56) References Cited

U.S. PATENT DOCUMENTS

| | | | | | |
|---|---|---|---|---|---|
| 2,787,337 | A | * | 4/1957 | Quayle | 187/238 |
| 3,394,778 | A | * | 7/1968 | Brinton | 187/227 |
| 3,506,092 | A | * | 4/1970 | Shinoda et al. | 187/226 |
| 3,871,494 | A | * | 3/1975 | Kelly, Jr. | 187/230 |
| 4,356,893 | A | * | 11/1982 | Johannson | 187/227 |
| 4,449,614 | A | | 5/1984 | Matsuda | 187/9 R |
| 4,657,471 | A | * | 4/1987 | Shinoda et al. | 414/663 |
| 4,683,988 | A | * | 8/1987 | Shrum, Jr. | 187/234 |
| 4,875,555 | A | * | 10/1989 | Johansson et al. | 187/226 |
| 4,949,816 | A | * | 8/1990 | Brown et al. | 187/227 |
| 5,758,747 | A | * | 6/1998 | Okazaki et al. | 187/227 |
| 6,264,004 | B1 | | 7/2001 | Miyamoto | 187/222 |
| 6,505,710 | B1 | * | 1/2003 | Kato | 187/230 |

FOREIGN PATENT DOCUMENTS

| | | | |
|---|---|---|---|
| JP | 08-295496 | | 11/1996 |
| JP | 08295496 | A * | 11/1996 |
| JP | 2005-067861 | | 3/2005 |

OTHER PUBLICATIONS

Canadian Office Action issued on Dec. 16, 2008 corresponding to the Canadian Patent Application 2,582,491.

* cited by examiner

*Primary Examiner*—Peter M Cuomo
*Assistant Examiner*—Eric Pico
(74) *Attorney, Agent, or Firm*—Locke Lord Bissell & Liddell, LLP

(57) ABSTRACT

A mast assembly of a forklift truck has outer and inner masts, a lift cylinder, a rearward projection and a cylinder support. The outer mast is supported by the truck body at the front thereof. The inner mast is movable upward and downward relative to the outer mast. The lift cylinder moves the inner mast relative to the outer mast. The rearward projection extending toward the truck body is mounted to the outer mast. The cylinder support is mounted to the rearward projection for supporting the lift cylinder at the bottom end thereof.

4 Claims, 6 Drawing Sheets

MAST ASSEMBLY IN FORKLIFT TRUCK

BACKGROUND OF THE INVENTION

The present invention relates to a mast assembly in a forklift truck having an outer mast supported by a truck body at the front thereof, an inner mast movable upward and downward relative to the outer mast and a lift cylinder for moving the inner mast relative to the outer mast.

Conventionally, various types of forklift trucks are known. Japanese Unexamined Patent Application Publication Nos. 2005-67861 and 8-295496 disclose a forklift truck having a mast assembly 21 a part of which is shown in FIG. 6. The mast assembly 21 has a pair of outer masts 22 (only one being shown in FIG. 6) mounted to the truck body at the front thereof, a mast support 24 mounted to each outer mast 22 at the bottom end thereof and a lower beam 26 connected to the mast support 24. Holes 26*a* (only one being shown in FIG. 6) are formed in both ends of the lower beam 26. The bottom end of a lift cylinder of the mast assembly 21 is inserted into the hole 26*a* so that the lift cylinder is supported by the lower beam 26.

There are various types of mast assemblies each having outer and inner masts and a lift cylinder of different sizes for different purpose of use. Thus, the number of components for such different mast assemblies tends to be increased. Furthermore, the lift cylinder is directly fixed to the lower beam which receives the thrust of the lift cylinder in operation to elevate the inner masts. The lower beam is also subjected to twisting force of the outer masts and also the force which is created when the outer masts are opened. The above mast assembly has been disadvantageous in that the above complex forces are applied to the joint which connects the lower beam to the mast support. In the structure wherein the lower beam is connected directly to the outer masts, the joints which connect the lower beam to the outer masts are subjected to the above complex forces. Therefore, there has been the need to increase the strength of the joint.

The supporting structure for the bottom end of the lift cylinder is provided by a lower beam that is a relatively large-sized component. Therefore, this supporting structure needs to be made by machining a large-sized work, which complicates the manufacturing process and increases the manufacturing cost.

The object of the present invention is to provide a mast assembly in a forklift truck, which permits the use of common components, restrains the development of the complex forces and reduces the manufacturing cost.

SUMMARY OF THE INVENTION

In accordance with an aspect of the present invention, a mast assembly of a forklift truck has outer and inner masts, a lift cylinder, a rearward projection and a cylinder support. The outer mast is supported by the truck body at the front thereof. The inner mast is movable upward and downward relative to the outer mast. The lift cylinder moves the inner mast relative to the outer mast. The rearward projection extending toward the truck body is mounted to the outer mast. The cylinder support is mounted to the rearward projection for supporting a bottom end of the lift cylinder.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
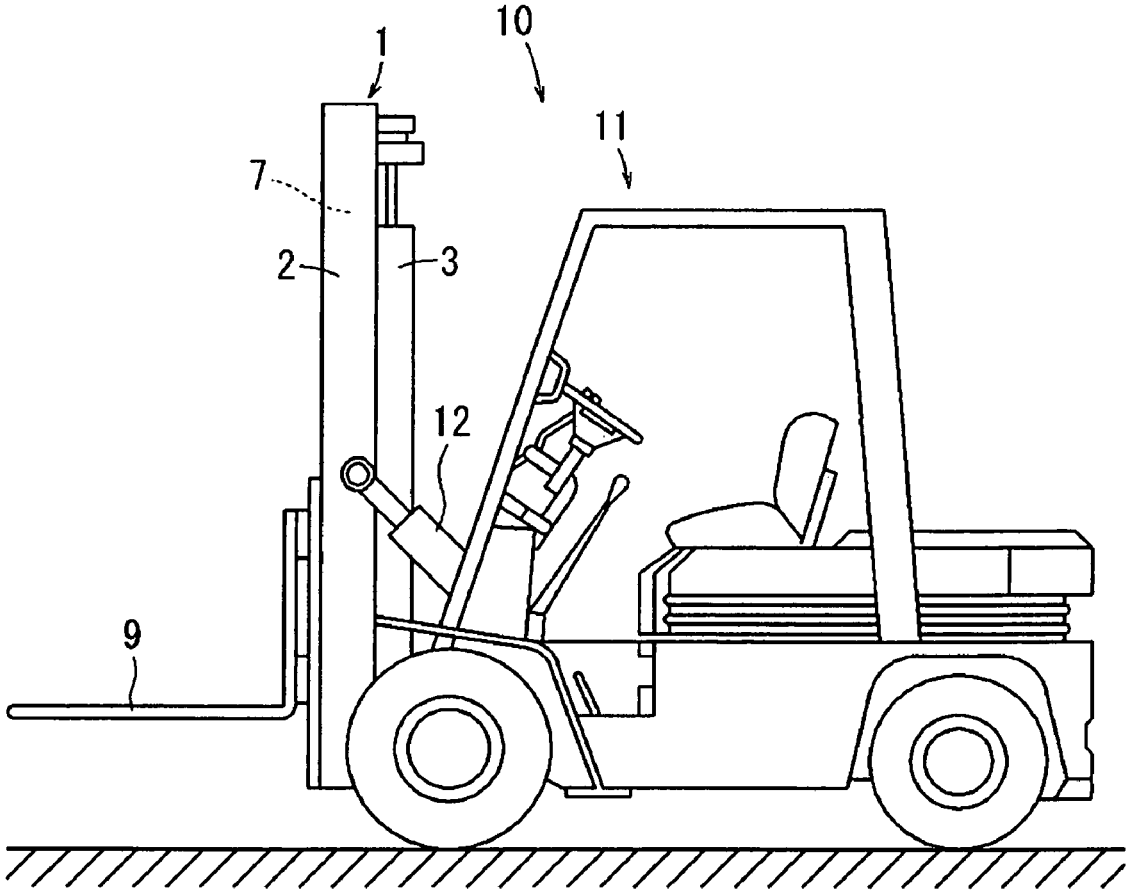
FIG. 1 is a left side view showing a forklift truck according to a first preferred embodiment of the present invention.

The following will describe a first embodiment of the present invention with reference to FIGS. 1 through 4. Referring to FIG. 1, a forklift truck 10 has a truck body 11, a mast assembly 1 and a fork 9. The mast assembly 1 has a pair of outer masts 2 and a pair of inner masts 7 which are movable upward and downward relative to the outer masts 2 and a pair of lift cylinders 3 for moving the inner masts 7 relative to the outer masts 2.

Figure 2:
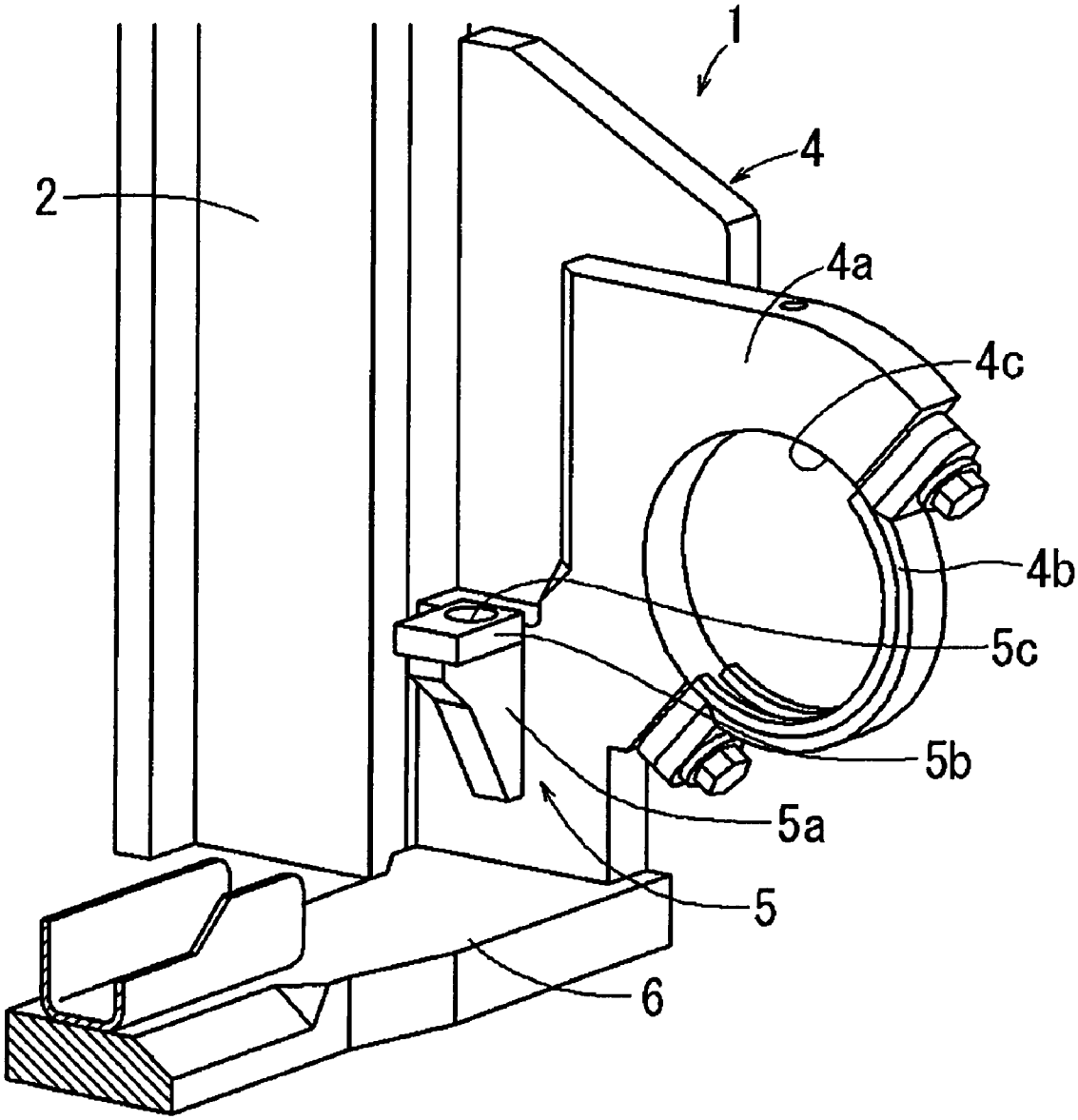
FIG. 2 is a perspective view showing an outer mast, a lower beam, a mast support and a cylinder support provided adjacent to the bottom end of the right outer mast according to the first preferred embodiment of the present invention.

The outer mast 2 is connected to the truck body 11 at the front thereof, as shown in FIG. 1. A mast support (or rearward projection) 4 mounted to the truck body 11 is welded to the bottom end of the outer mast 2, as shown in FIG. 2. The mast support 4 has a main portion 4*a* extending toward the truck body 11 from the outer mast 2 and a cap portion 4*b*. A hole 4*c* is formed between the main portion 4*a* and the cap portion 4*b*. The cap portion 4*b* of the mast support 4 is fixed to the main portion 4*a* by a bolt such that the front axle of the truck body 11 is inserted through the hole 4*c*, so that the outer mast 2 is tiltably mounted to the front axle of the truck body 11.

Figure 4:
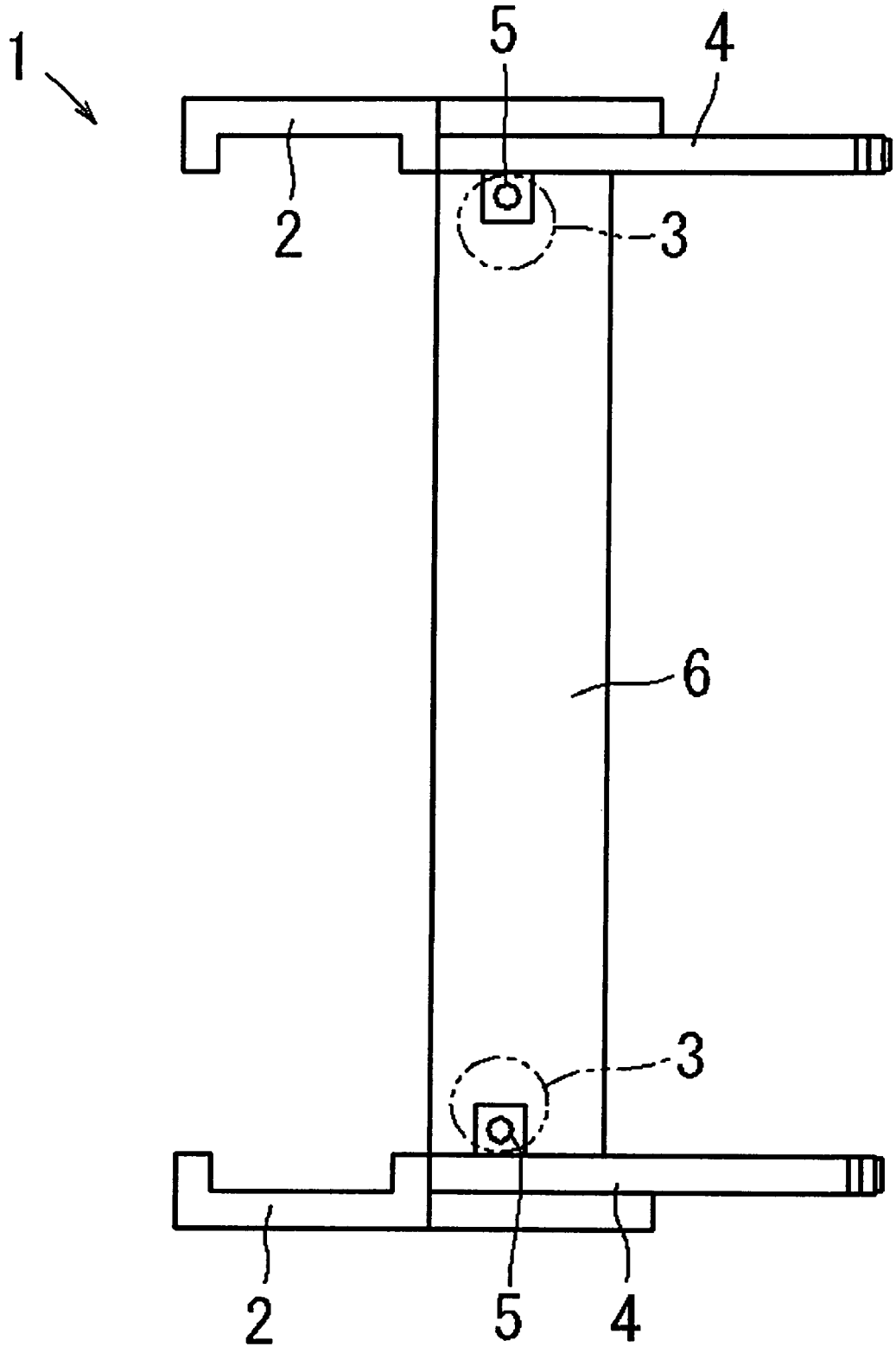
FIG. 4 is a top view showing the outer mast, the lower beam and the mast support according to the first preferred embodiment of the present invention.

The paired outer masts 2 are connected to each other by three cross beams, namely, an upper beam, a tilt beam and a lower beam 6. As shown in FIG. 4, the opposite ends of the lower beam 6 are welded to the bottom ends of the mast supports 4. The bottom ends of the pair of the outer masts 2 are connected to each other through the mast supports 4 and the lower beam 6. As shown in FIG. 1, the tilt beam is connected to the truck body 11 by a hydraulic tilt cylinder 12. Thus, the outer mast 2 is tiltable by extending and retracting operation of the tilt cylinder 12.

Referring to FIG. 2, a cylinder support 5 is fixedly mounted to the mast support 4 on one lateral side thereof. The cylinder support 5 consists of two parts, namely, a base 5*a* and a horizontally positioning block 5*b*. The base 5*a* is fixed to the lateral side of the mast support 4 by welding after the base 5*a* has been positioned away from the lower beam 6 by adjustment in the vertical direction (Z direction) and the longitudinal direction (Y direction) of the forklift truck 10. The base 5*a* projects from the center of the inwardly facing lateral side of the main portion 4*a* of the mast support 4 and above the lower beam 6.

Figure 3:
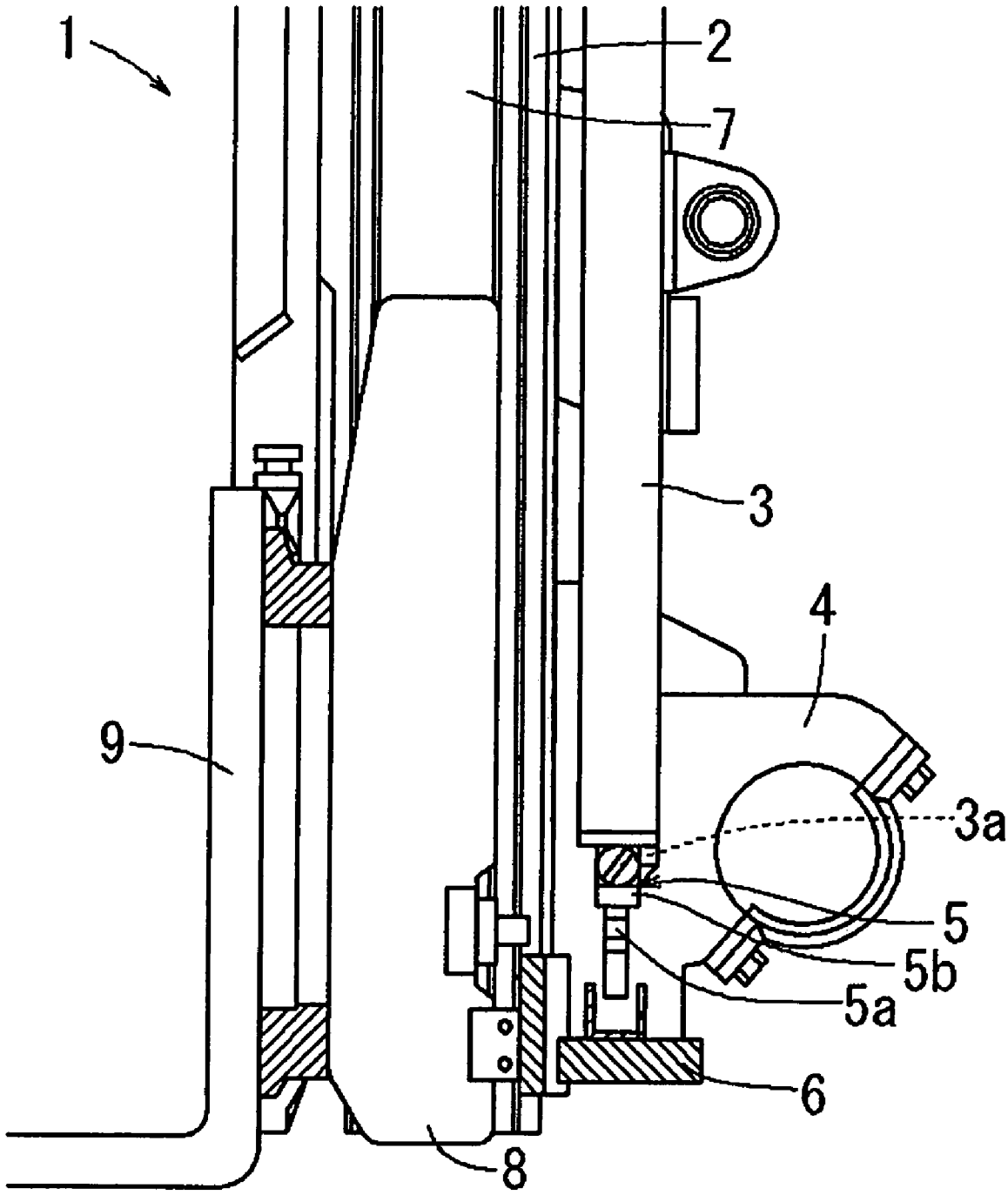
FIG. 3 is a left side view showing the outer mast, the mast support, an inner mast, a lift cylinder and a lift bracket provided adjacent to the bottom end of the right outer mast according to the first preferred embodiment of the present invention.

As shown in FIG. 2, the base 5*a* is formed at the top thereof with a horizontal surface and the horizontally positioning block 5*b* is mounted on the horizontal surface. Before mounting the horizontally positioning block 5*b*, its position is determined by adjustment in the widthwise direction (X direction) and the longitudinal direction (Y direction) on the horizontal surface of the base 5*a*. Namely, the position of the horizontally positioning block 5*b* is adjusted in the horizontal direction and then the horizontally positioning block 5*b* is fixed to the base 5*a* by welding. The horizontally positioning block 5*b* has a hole 5*c* extending in the vertical direction. As shown in FIG. 3, a projection 3*a* formed at the bottom end of the cylinder tube of the lift cylinder 3 is inserted into the hole 5*c*. Thus, the lift cylinder 3 is mounted at the bottom end thereof to the horizontally positioning block 5*b*.

Referring to FIG. 3, the lift cylinder 3 extends in the vertical direction along the outer mast 2 and has a cylinder rod moving in and out relative to a tubular cylinder tube. The distal end of the cylinder rod is connected to the inner mast 7. The inner mast 7 is located in the rail of the outer mast 2 formed on the inner side of the outer mast 2 and movable for elevation along the outer mast 2. Accordingly, the inner mast 7 is movable relative to the outer mast 2 by extending and retracting operation of the lift cylinder 3.

A lift bracket 8 which is movable in conjunction with elevating motion of the inner mast 7 is provided between the inner masts 7. The fork 9 is mounted to the front of the lift bracket 8 and a chain is fixed at one end thereof to the top end of the lift bracket 8. The chain is wound around a chain wheel supported at the top of the inner mast 7. The chain is fixed at the other end thereof to the cylinder tube of the lift cylinder 3 or the outer mast 2. Accordingly, elevating the inner mast 7 causes the lift bracket 8 to be elevated through the chain.

Mechanisms for preventing the lift cylinder 3 from rotating relative to the inner mast 7 and the lift cylinder 3 from drawing off from the inner mast 7 are installed between the distal end of the lift cylinder 3 and the inner mast 7.

The following describes the method of assembling the mast assembly 1. Firstly each mast support 4 is welded to the outer mast 2, and then the cross beams, namely the upper beam, the tilt beam and the lower beam 6, are mounted to the paired mast supports 4. The base 5*a* of the cylinder support 5 is fixed to the mast support 4 by welding. In fixing the base 5*a*, the vertical position (Z direction) of the base 5*a* relative to the mast support 4 is determined in accordance with the length of the lift cylinder 3 and the length of the inner mast 7. Subsequently, the horizontally positioning block 5*b* is fixed to the base 5*a* by welding at such a horizontal position (X direction and Y direction) relative to the base 5*a* that the paired lift cylinders 3 extend parallel to each other.

As shown in FIG. 2, the mast support (or rearward projection) 4 extending toward the truck body 11 is mounted to the outer mast 2, and the cylinder support 5 supporting the lift cylinders 3 at their bottom ends is mounted to the mast support 4. Therefore, positioning the cylinder support 5 in the vertical direction relative to the mast support (rearward projection) 4, the vertical position of the lift cylinder 3 is determined. Thus, the height of the lift cylinder 3 may be determined in accordance with the length of the lift cylinder 3 and the lengths of the masts, such as the outer mast 2 and the inner mast 7. This allows mast assembly 1 to use common components, such as a lift cylinder and a mast which have been needed to be prepared for each different type of mast assembly 1.

The lift cylinder 3 is supported by the mast support 4 through the cylinder support 5. Therefore, the thrust of the lift cylinder 3 in elevating the inner mast 7 is not directly transmitted to the lower beam 6. This reduces the complex forces which are applied to the joint between the lower beam 6 and the mast support 4 due to the thrust of the lift cylinder 3. The cylinder support 5 supporting the bottom end of the lift cylinder 3 is a component that is smaller than the lower beam 6. The structure of supporting the bottom end of the lift cylinder 3 makes the process of machining parts of the mast assembly relatively easy and reduces the manufacturing cost, accordingly. This embodiment can use common components, suppress the generation of the complex forces and reduce the manufacturing cost.

In addition, according to the present embodiment, the cylinder support 5 is connected to the mast support 4 which is mounted to the front axle of the truck body 11. Therefore, the cylinder support 5 is mounted to a conventionally existing component instead of any component newly mounted to the outer mast 2. This permits the use of common components and, therefore, prevents the number of the components from increasing.

Furthermore, according to the present embodiment, the cylinder support 5 has the base 5*a* which is fixed to the mast support 4 and the horizontally positioning block 5*b* which is connected to the horizontal surface of the base 5*a* such that it is positioned in a horizontal direction, as shown in FIG. 2. The lift cylinder 3 is mounted at the bottom end thereof to the horizontally positioning block 5*b*. Meanwhile, the cylinder support 5 is mounted to the outer mast 2 at a predetermined vertical position with respect to the bottom end of the outer mast 2. If a slight difference in tilt angle is made between the paired outer masts 2 during assembling thereof, the paired cylinder supports 5 will not be positioned at an accurate spaced interval, with the result that accurate parallelism of the paired lift cylinders 3 will not be achieved. According to the present embodiment of a mast assembly, however, the horizontally positioning block 5*b* is mounted on the base 5*a* in horizontal position. The bottom end of the lift cylinder 3 connected to the horizontally positioning block 5*b* may be positioned in horizontal direction, so that the pair of the lift cylinders 3 may be disposed in accurate parallel relation each other. As a result, energy loss caused by the deformation of the lift cylinders 3 due to twisting and other forces may be reduced.

The horizontally positioning block 5*b* has the hole 5*c* extending vertically and the bottom end of the lift cylinder 3 is inserted into this hole 5*c*. The cylinder support 5 is simple in structure in that the hole 5*c* is formed in the horizontally positioning block 5*b*.

The cylinder support 5 is positioned away from the lower beam 6 as shown in FIG. 2 and therefore, the thrust of the lift cylinder 3 supported by the cylinder support 5 is prevented from acting directly on the lower beam 6.

A second embodiment according to the present invention will be described with reference to FIG. 5. The second embodiment differs from the first embodiment in that a cylinder support 15 is used in place of the cylinder support of FIG. 2. The following description of the second embodiment will be made focusing on the differences.

Figure 5:
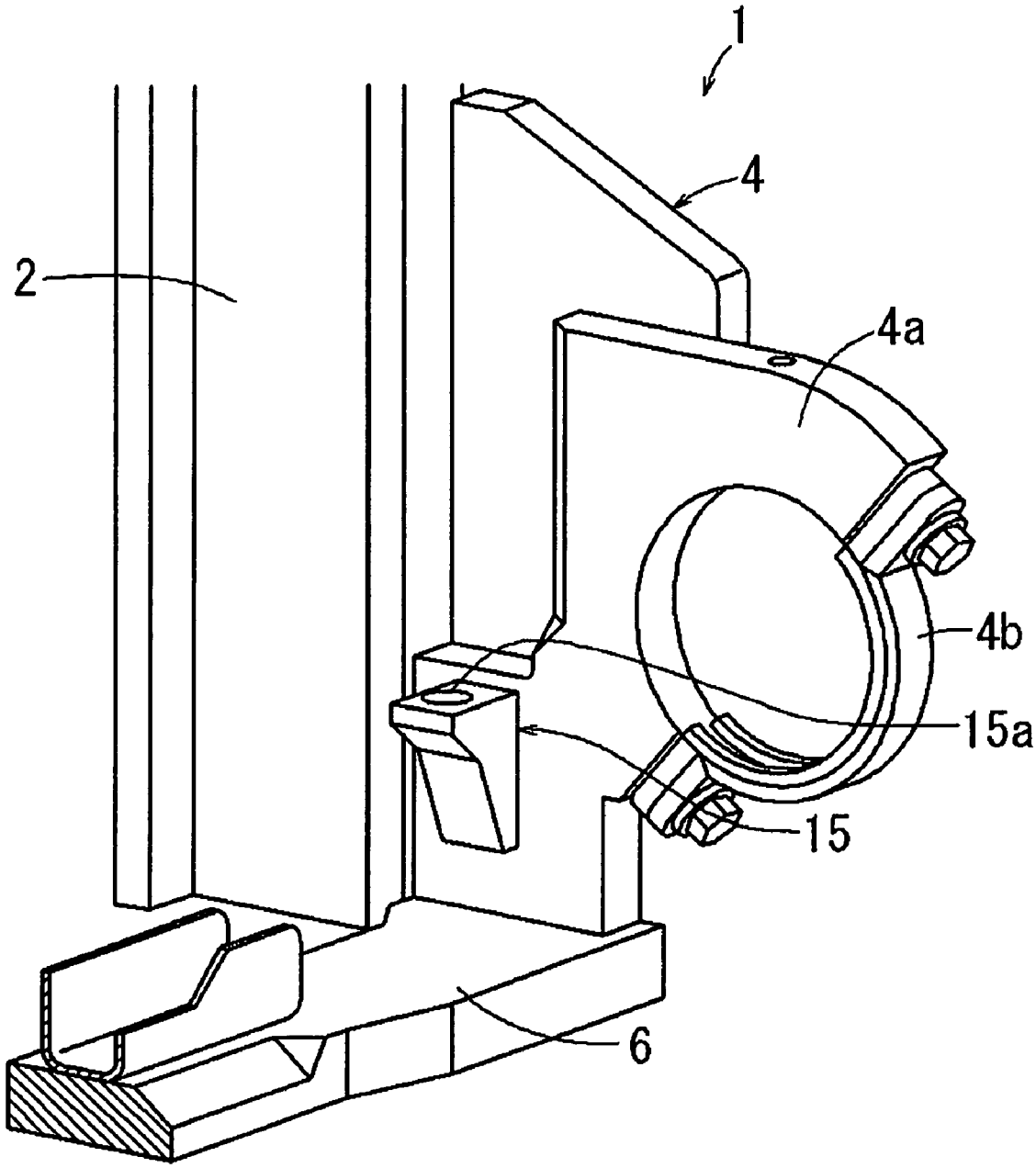
FIG. 5 is a perspective view showing an outer mast, a lower beam, a mast support and a cylinder support provided adjacent to the bottom of the right outer mast according to a second preferred embodiment of the present invention.
Figure 6:
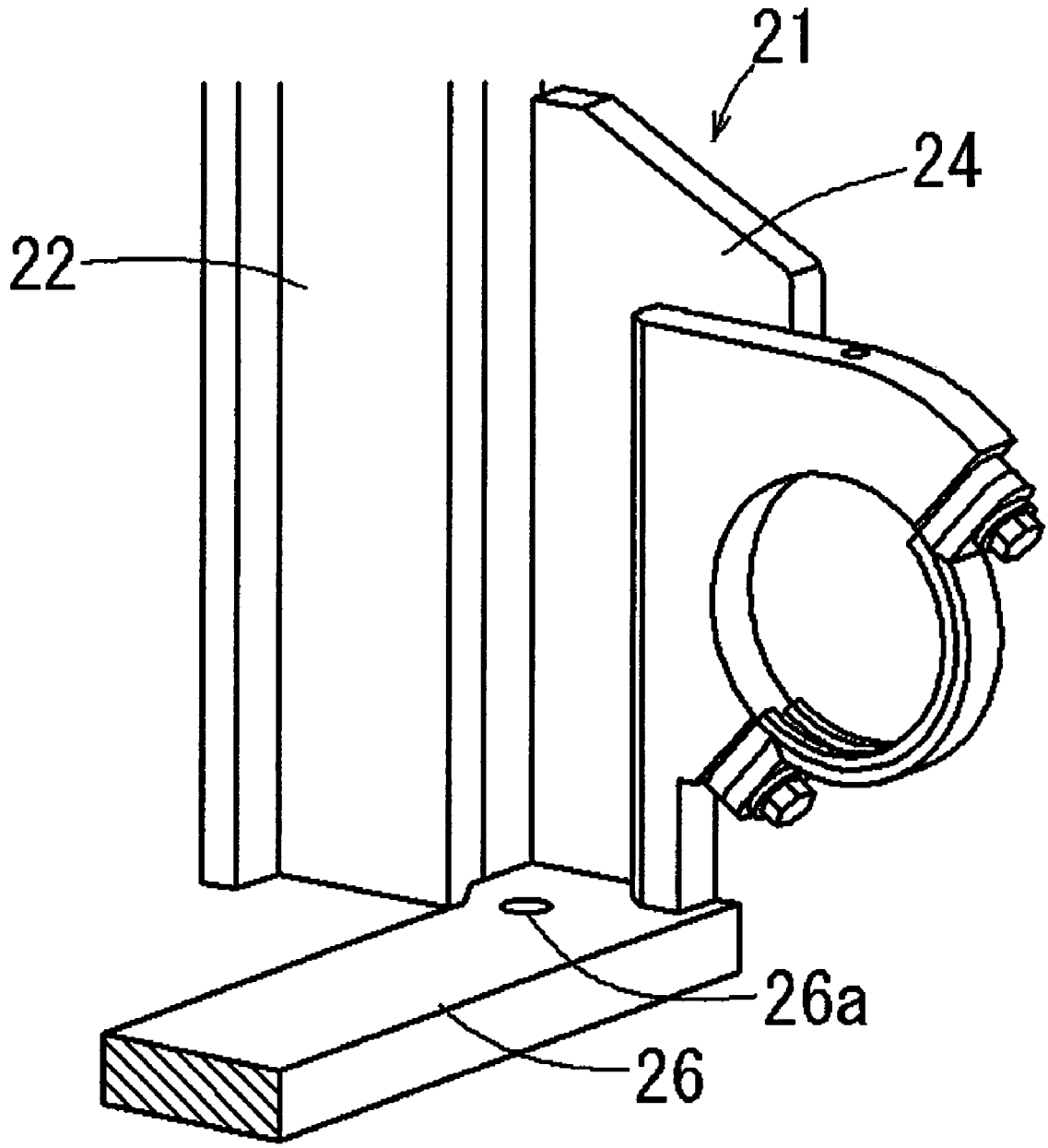
FIG. 6 (PRIOR ART)
FIG. 6 is a perspective view showing an outer mast, a lower beam and a mast support of a conventional mast assembly.

The cylinder support 15 is constructed of only one member and it is positioned and fixed to the lateral side of the main portion 4*a* of the mast support 4, as shown in FIG. 5. The cylinder support 15 is formed in the top portion thereof with a hole 15*a* for receiving therein a projection which is formed at the bottom end of the lift cylinder. Thus, the bottom end of the lift cylinder is supported by the cylinder support 15.

Constructing the cylinder support 15 of only one component, the number of the components is relatively small. The cylinder support 15 is mounted to the lateral side of the mast support 4 and the hole 15*a* is formed in the cylinder support 15. Therefore, the cylinder support 15 is positioned at a predetermined height on the lateral side of the mast support 4 and the lift cylinder is supported at the bottom end thereof by the hole 15*a* of the cylinder support 15.

The present invention is not limited to the above described first and second embodiments, but it may be practiced in other various ways as exemplified below.

(1) The outer mast according to the first and second embodiments has the mast support extending toward the truck body and the cylinder support is fixed to the mast support. However, a rearward projection extending from the outer mast toward the truck body may be provided independently of the mast support and the cylinder support may be fixed to the rearward projection.

(2) According to the first embodiment, the base of the cylinder support is fixed to the mast support by welding and the horizontally positioning block is fixed to the base by welding. According to the second embodiment, the cylinder support is fixed to the mast support also by welding. However, these components may be fixed to the mast support by means of a fastener, such as a bolt or the like.

(3) The base of the cylinder support according to the first embodiment has a horizontal surface at the top portion thereof. However, a horizontal surface may be formed in any place of the base and the horizontally positioning block may be positioned and fixed to the horizontal surface.

(4) The cylinder support according to the first and second embodiments is mounted to the lateral side of the mast support. However the cylinder support may be provided on to the top surface of the mast support.

(5) The mast assembly according to the first and second embodiments is a two-stage lift type assembly having an outer mast and an inner mast. According to the present invention, however, the mast assembly may be of a three-stage lift type having an additional middle mast.

(6) Mechanism for preventing the lift cylinder from rotating relative to the inner mast and mechanism for preventing the lift cylinder from drawing off from the inner mast are installed between the distal end of the lift cylinder and the inner mast according to the first and second embodiments. Instead of the above arrangements, such mechanisms may be installed between the bottom end of the lift cylinder and the cylinder support.

Therefore, the present examples and embodiments are to be considered as illustrative and not restrictive, and the invention is not to be limited to the details given herein but may be modified within the scope of the appended claims.

What is claimed is:

1. A mast assembly in a forklift truck having a truck body comprising:

outer masts supported by the truck body at the front thereof;

an inner mast movable upward and downward relative to the outer masts;

a lower beam connecting to the bottom ends of the outer masts;

a pair of lift cylinders for moving the inner mast relative to the outer masts;

a pair of mast supports mounted on a front axle of the truck body, wherein the each mast support forms a rearward projection extending toward the truck body and mounted on the outer masts; and a pair of cylinder supports, the first cylinder support fixed to one lateral side of the first mast support for supporting a bottom end of the first lift cylinder and the second cylinder support fixed to one lateral side of the second mast support for supporting a bottom end of the second lift cylinder, the pair of cylinder supports spaced apart from and vertically above the lower beam, each cylinder support having a hole for receiving therein a projection which is formed at the bottom end of each lift cylinder, wherein the pair of cylinder supports is positioned away from the lower beam so that the thrust of the pair of lift cylinders does not act directly on the lower beam.

2. The mast assembly according to claim 1, wherein the pair of cylinder supports comprising:

a base fixed to the rearward projection; and a horizontally positioning block mounted on a horizontal surface formed in the base such that the horizontally positioning block is positioned in a horizontal direction, wherein the pair of lift cylinders is mounted at the bottom end thereof to the horizontally positioning block.

3. The mast assembly according to claim 2, wherein the horizontally positioning block has a hole extending in the vertical direction, the bottom end of each of the lift cylinders being inserted into the hole.

4. The mast assembly according to claim 2, wherein the horizontal surface formed in the base is formed at the top of the base.

* * * * *